US006711767B2

(12) United States Patent
Klamm

(10) Patent No.: US 6,711,767 B2
(45) Date of Patent: Mar. 30, 2004

(54) APPARATUS FOR WARMING A BED

(76) Inventor: Thomas Klamm, 4214 Lathrop Ave., Racine, WI (US) 53403

( * ) Notice: Subject to any disclaimer, the term of this patent is extended or adjusted under 35 U.S.C. 154(b) by 0 days.

(21) Appl. No.: 10/351,153

(22) Filed: Jan. 24, 2003

(65) Prior Publication Data

US 2003/0140418 A1 Jul. 31, 2003

Related U.S. Application Data

(60) Provisional application No. 60/352,741, filed on Jan. 30, 2002.

(51) Int. Cl.[7] ..... A47C 21/04

(52) U.S. Cl. ..... 5/423; 5/505.1; 607/107

(58) Field of Search ..... 5/423, 421, 426, 5/505.1, 506.1; 62/261; 607/96, 107

(56) References Cited

U.S. PATENT DOCUMENTS

| | | | | |
|---|---|---|---|---|
| 1,142,876 A | | 6/1915 | Davis et al. | |
| 2,097,751 A | | 11/1937 | Baltich | |
| 2,461,432 A | | 2/1949 | Mitchell | |
| 3,101,488 A | | 8/1963 | Peebles | |
| 3,230,556 A | | 1/1966 | Shippee | |
| 3,317,932 A | | 5/1967 | Gibbons, Sr. | |
| 3,444,922 A | | 5/1969 | Dingman | |
| 3,713,182 A | | 1/1973 | McNeal | |
| 4,937,903 A | | 7/1990 | Joly et al. | |
| 4,939,804 A | | 7/1990 | Grant | |
| 4,984,316 A | | 1/1991 | Simpson et al. | |
| 5,730,120 A | * | 3/1998 | Yonkers, Jr. | 5/423 |
| 5,887,303 A | | 3/1999 | Raith | |
| 5,943,716 A | | 8/1999 | Chu | |
| 6,473,920 B2 | | 11/2002 | Augustine et al. | |

* cited by examiner

*Primary Examiner*—Alexander Grosz
(74) *Attorney, Agent, or Firm*—George E. Haas; Quarles & Brady LLP

(57) ABSTRACT

A device is provided to heat bed covers prior to a person entering the bed on winter nights. This apparatus mounts on a side of the mattress being supported by adjustable elements that extend between the mattress and a box spring. A fan in the apparatus forces room air through an electric heating coil and then through an outlet which directs the air flow between the bed covers.

12 Claims, 3 Drawing Sheets

APPARATUS FOR WARMING A BED

CROSS-REFERENCE TO RELATED APPLICATIONS

This application claims benefit of U.S. Provisional Patent Application No. 60/352,741 filed Jan. 30, 2002.

STATEMENT REGARDING FEDERALLY SPONSORED RESEARCH OR DEVELOPMENT

Not Applicable

BACKGROUND OF THE INVENTION

1. Field of the Invention

The present invention relates to devices for warming a bed, and particularly to electrically powered devices that blow heated air between bed covers.

2. Description of the Related Art

During the winter in cold climates, an unoccupied bed becomes relatively cold. Thus a person entering the bed is exposed to bedding surfaces which are considerably colder than human body temperature. It takes some time for the person's body heat to warm the bed.

Various devices have been created to talk the chill off of bedding so that a person upon entering the bed is not be exposed to cold surfaces in the winter. One common approach is to turn-on an electric blanket prior to entry into the bed to warm the region in which the person will sleep. Other devices supplied heated air into a space between the bed coverings. For example, U.S. Pat. No. 15,887,303 discloses a conduit which conducts air into the bed from a register of a forced air heating system of the building. However, that latter device does not evenly distribute the warm air throughout the bed and does not allow the user to control the temperature or flow of the air being forced into the bed. In addition, this latter system functions only with the normal thermostatically controlled heating system for the building.

SUMMARY OF THE INVENTION

A bed warming apparatus is provided to heat the bed covers prior to a person entering the bed on winter nights. This apparatus mounts on the bed being supported by elements that extend between the standard mattress and box spring. A fan forces room air through an electric heating coil in the apparatus and then through an outlet which directs the air flow between the bed covers.

The bed warning apparatus has a housing with an air inlet and an air outlet. A heater and a fan are contained within the housing with the fan producing a flow of air from the air inlet through the heater to the air outlet. A support is adjustably coupled to the housing and is adapted to extend under the mattress to hold the housing along an edge of the mattress in a position wherein the air flow from the air outlet is directed between the bed covers.

In a preferred embodiment of the housing, the air inlet is located on a bottom end with the air outlet located near the top of a side wall. A plurality of pails of apertures are located in the side wall with the pairs of apertures being stacked vertically. The support comprises first and second support legs selectively received in one of the pairs of apertures. Selection of the particular pair of apertures in which the first and second support legs are received adjusts a spatial relationship of the housing to the mattress so that the flow of air from the air outlet is directed between the mattress bed covering.

Another aspect of the present invention provides a user operable controller for activating the fan and the heater. Preferably the user operable controller enables the fan to be activated with and without activating the heater. An optional timer can be provided to deactivate the heater after a defined period of time.

DETAILED DESCRIPTION OF THE PREFERRED EMBODIMENTS

Figure 1:
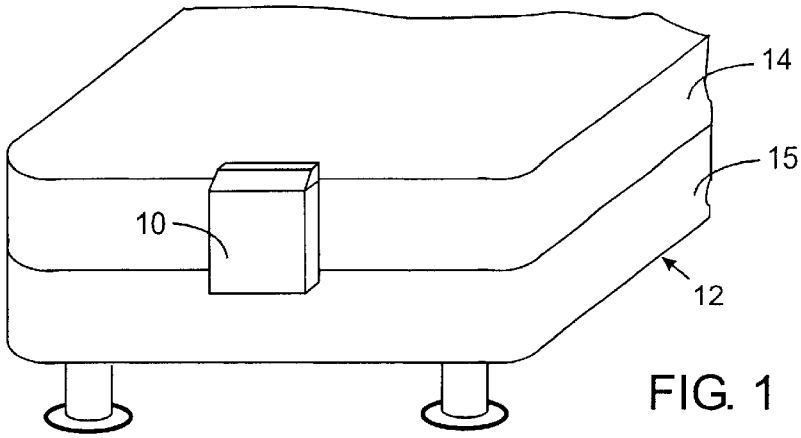
FIG. 1 is an isometric view of a bed on which a first embodiment of a apparatus has been installed.
Figure 2:
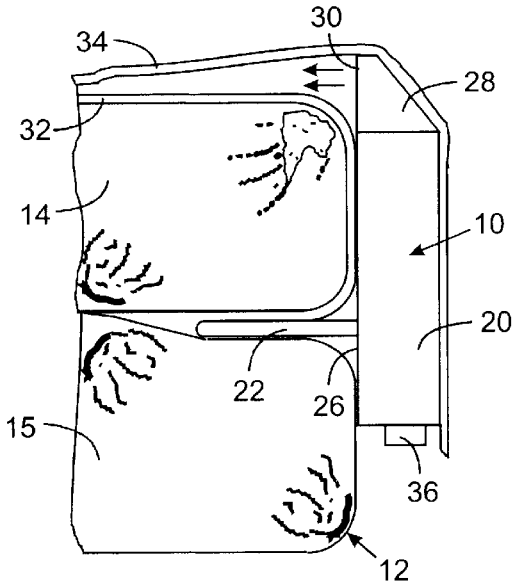
FIG. 2 is a side view of the bed and the warming apparatus.
Figure 3:
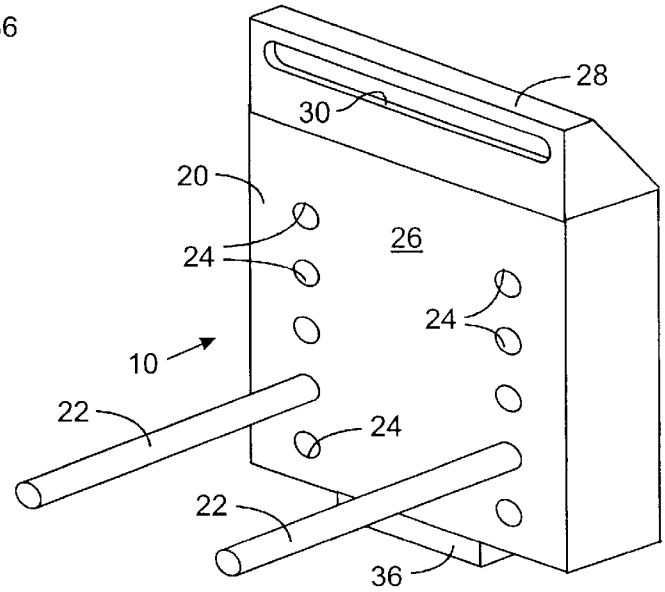
FIG. 3 is a view of a side of the warming apparatus that faces the bed.

With initial reference to FIGS. 1 and 2, an apparatus 10 is provided to warm a bed 12, which has a conventional mattress 14 on top of a standard box spring 15. The bed warming apparatus 10 has a housing 20 from which a pair of support legs 22 project between the mattress 14 and box spring 15 to hold the apparatus 10 at the foot of the bed 12. As seen in FIG. 3, a surface 26 of the housing 20 that faces the bed has a plurality of apertures 24 arranged in two columns in which apertures in each columns are arranged horizontally in pairs. Each aperture 24 is sized to securely receive one of the support legs 22. By placing the support legs 22 into different apertures 24 in each column, the spatial relationship (i.e. the height) of the apparatus 10 with respect to the top surface of the mattress 14 can be adjusted.

With continuing reference to FIG. 3, the upper portion of housing 20 has an air deflector plenum 28 with a horizontally elongated outlet aperture 30 through which air flows from the apparatus. The support legs 22 are positioned in apertures 24 so that when the legs are inserted between the mattress and box spring 14 and 15, the outlet aperture 30 is above the upper surface of the mattress 14 and a lower sheet 32 thereon, as shown in FIG. 2. Thus the legs 22 form an adjustable support for the bed warming apparatus 10. When the bed 12 is made up for sleeping, the upper sheet 34 and any blanket, quilt or bedspread (not shown) are draped over the mattress 14 and the housing 20. The upper sheet 34 and any other bedding hang over the housing 20 and are not tucked between the mattress and box spring 14 and 15. This exposes an air inlet 36 at the bottom of the housing 20 so that air from beneath the bed is drawn upward into the housing, as will be described.

Figure 4:
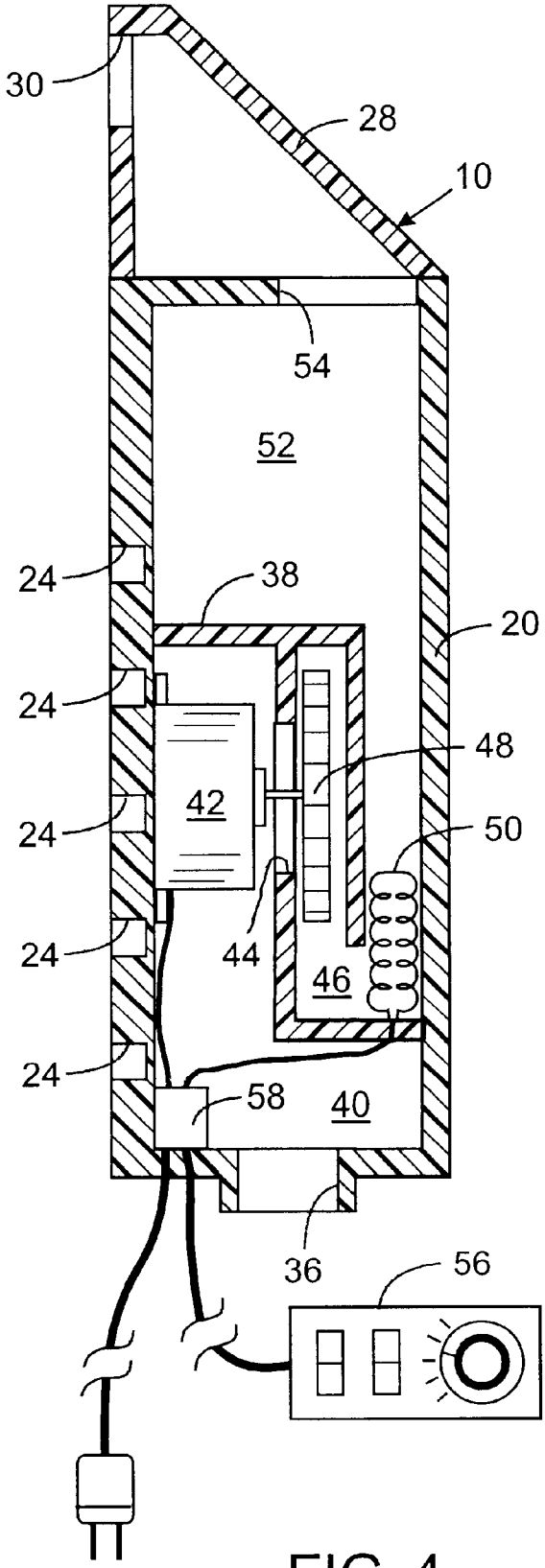
FIG. 4 is a cross-section view of the warming apparatus.

Referring to FIG. 4, the housing 20 has an interior wall 38 which divides the housing interior into inlet chamber 40, a passage 46 and an outlet chamber 52. The air inlet 36 opens into the inlet chamber 40. An electric motor 42 is located within the inlet chamber 40 and has a shaft that extends through an aperture 44 in the wall 38 and into the U-shaped passage 46. A conventional rotary fan 48 is attached within the passage 46 to the motor's shaft and rotates when the motor is energized. The fan 48 draws air from the inlet chamber 40 through the aperture 44 and forces the air along the passage 46. An electric heating coil 50 is located within the passage 46 downstream of the fan 48 to heat the air flowing there through the passage 46 opens into the outlet chamber 52 through which the air travels via a housing aperture 54 into the air deflector plenum 28 and out through the outlet 30.

A hand-held controller 56 enables the user to turn the bed warming apparatus 10 on and off and regulate the temperature of the heating element 50 and thus the temperature of air emitted into the bed. The fan 42 can be operated without energizing the heating element 50 to blow unheated room air into the bed 12. An optional timer 58 may be provided to turn off the bed warmer 10 automatically after a defined period of time. Thus, the bed warmer shuts off even if the user falls asleep. The automated shutoff feature also prevents the bed from overheating in the event that the apparatus is left unattended.

When a person retires for the night, the bed warming apparatus 10 is activated for a few minutes prior to entering the bed. This blows heated air between the two sheets 32 and 34 warming the sleeping surfaces. When the person enters the bed, the air flows around the occupant. Specifically, the fan 42 drafts air from below the bed through the air inlet 36 into the housing 20 in which the air continues to flow through the aperture 44 in the inner wall 38 and into the passage 46. It the heating element 50 is energized, the air flowing through the passage 46 is heated. The air continues to flow from the passage 46 through the outlet chamber 52 into the air deflector plenum 28. The air exits the bed warming apparatus 10 through the air outlet 30 and flows between the sheets 32 and 34, as indicated by arrows 56 in FIG. 2.

Figure 5:
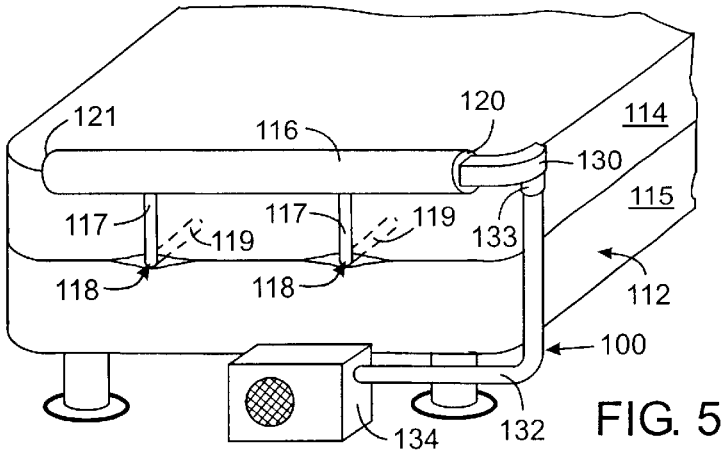
FIG. 5 is an isometric view of a bed on which a second embodiment of a warming apparatus has been installed.

With reference to FIG. 5, a second embodiment of an apparatus 100 is provided to warm a bed 112, which has a conventional mattress 114 on top of a standard box spring 115. The bed warming apparatus 100 includes an air distribution plenum 116 formed by a tube of plastic or similar material which extends across substantially the entire width of the mattress, preferably at the foot of the bed. If the person enters the bed from only one side, the air distribution plenum call be placed lengthwise along the opposite side. Attached to the air distribution plenum 116 are a pair of L-shaped supports 118, each having a first leg 117 extending vertical downward from the plenum and a second leg 119 projecting horizontally from the first leg between the mattress 114 and box spring 115. This engagement of the supports 118 between the mattress and box spring securely holds the air distribution plenum 116 on the bed 112 in a position in which the plenum extends slightly above the upper surface of the mattress 114, as shown in FIGS. 6 and 7.

Figure 6:
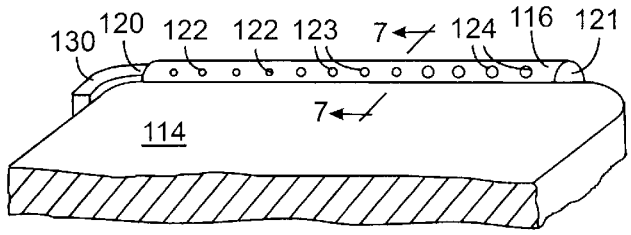
FIG. 6 illustrates the relationship of an air distribution plenum of the second embodiment to the foot of the mattress.

With continuing reference to FIG. 6, the air distribution plenum 116 has an inlet end 120 and a closed opposing end 121 with a plurality of outlet apertures 122, 123 and 124 spaced periodically between the two ends. The outlet apertures 122–24 increase in size going the inlet end 120 to the outlet end 121. Specifically outlet apertures 122 nearest the inlet end 120 are smaller than the centrally located outlet apertures 123, which in turn are smaller than the outlet apertures 124 that are even farther from the inlet end. The varying of size of the outlet apertures 122–24 balances the flow of air through the apertures so as to evenly distribute the air flow across the foot of the bed 112.

Figure 7:
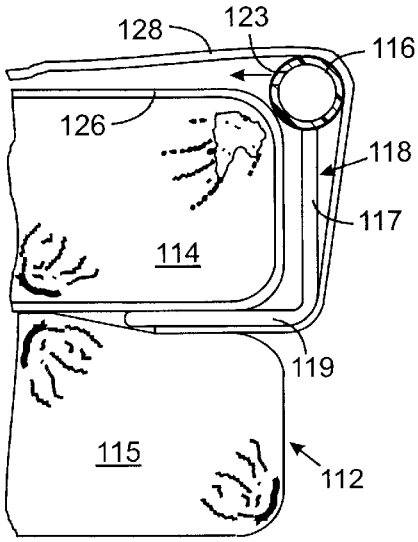
FIG. 7 is a cross-sectional view along line 7—7 in FIG. 6 and furthering illustrating the installation of the air distribution plenum.

As seen in FIG. 7, when the bed 112 is made up for sleeping, the supports 118 of the apparatus 100 extend between the mattress 114 and box spring 115. A conventional sheet 126 is fitted tightly around the mattress 114 extending between the mattress and the air distribution plenum 116. An upper sheet 128 is tucked between the upper surface of the box spring 115 and the supports 118. The upper sheet 128 then wraps around the outside of the supports 118 and air distribution plenum 116 and is laid across the top of the mattress 114. In this arrangement, the ail distribution plenum 116 is between the upper and lower sheets 128 and 126. Note further that the projection of the air distribution plenum 116 above the upper surface of the mattress 114 creates a space between the two sheets 126 and 128 through which air is able to flow from the outlet apertures 118–20. Additional bed covers, Such as a blanket, may be placed on top of the upper sheet 128.

Referring once again to FIGS. 5 and 6, the inlet end 122 of the air distribution plenum 116 has an air flow diverter 130 connected thereto. The air flow diverter 130 is a hollow arcuate body which communicates with an opening at the inlet end 122 of the air distribution plenum 116. The air flow diverter 130 curves around one corner of the mattress 114 and has an opposite end extending along the side of the mattress. A flexible air duct 132 is connected to check valve 133 at an opening in the bottom of the air flow diverter 130 at the end that is along side the mattress 114. The flexible air duct 132 may be similar to those used in building HVAC systems or to the exhaust air from clothes dryers. The check valve 133 closes the opening into the air flow diverter 130 when air is not being forced through the flexible air duct 132. This prevents cooler room air from entering between the bed covers when the bed warming apparatus 100 is not operating. The other end of the flexible duct 132 connects to a fan and heater unit 134 of the bed warming apparatus 1001 the air flow diverter 30 enables connection to the flexible air duct 132 to be made without interfering with the conventional manner in which the sheets and other bed coverings are tucked between the mattress and box spring at the foot of the bed. Specifically, that connection is along side the bed 112 where the bed covers merely fall vertically downward over the air flow diverter 130 and flexible air duct 132. It should be understood that the air flow diverter 130 can be attached at the opposite end of the air distribution plenum 116 and the pattern of the outlet apertures 122–24 reversed. Furthermore, other variations of the present bed warming apparatus could have the inlet for the flexible air duct 132 located anywhere along the length of the air distribution plenum 116.

Figure 8:
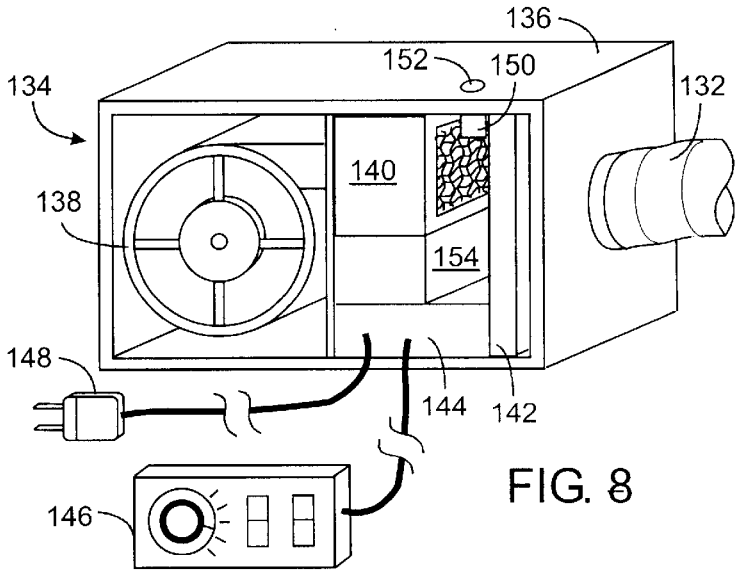
FIG. 8 shows the fan and heater unit of the second bed warming apparatus

Referring to FIG. 8, the fan and heater unit 134 has a housing 136 within which is mounted a fan 138 that blows air from the room through an electric heating coil 140 and air filter 142 into the flexible duct 132. Any of several standard types of fans may be utilized. A conventional control circuit 144 governs the speed of the fan 138 and the temperature of the heating coil 140. The operation of the control circuit 144 is controlled by a user input device 146 which enables the person using the bed to turn on and off the warning apparatus 100 and regulate the speed and temperature of the air flow. A thermostat (not shown) is provided at the outlet of the heating coil 140 to the control circuit to turn of the heating coil and prevent the unit 134 from overheating. An electric cord 148 supplies power to the fan and heating unit 134 from a standard 110 volt electrical outlet in the building.

A whistle 150 is provided in a chamber 154 between the heating coil 140 and the filter 142 and extends through an opening 152 in the housing 136. When the filter 142 becomes sufficiently clogged so as to inhibit adequate air flow, air pressure builds up in the chamber 154. The increase in pressure forces air through the whistle 150, which thereby emits a sharp sound providing an audible indication of the need to replace or clean the air filter 142. Access to the air filter 142 for servicing is accomplished by removing the cover of the housing 136, as shown in FIG. 8.

In applications of the present invention in which automatic control is not required, the particular blower and heater unit 134 shown in the drawings may be replaced by a conventional, portable hair dryer. In this case, the flexible air duct 132 is connected to the outlet of the portable hair dryer which function as the blower and heater unit The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. An apparatus for warming a bed having a mattress covered by a bed covering, said apparatus comprising:

a housing having an air inlet and an air outlet;

a heater within the housing;

a fan within the housing for producing a flow of air from the air inlet through the heater to the air outlet; and a support adjustably coupled to the housing and adapted to extend under the mattress to hold the housing along an edge of the mattress, wherein the flow of air from the air outlet is directed between the mattress and the bed covering.

2. The apparatus as recited in claim 1 wherein the housing has a plurality of apertures for receiving the support wherein the support is selectively received into one of the apertures to adjust a spatial relationship between the mattress and the air outlet.

3. The apparatus as recited in claim 1 wherein the support comprises first and second support legs, and the hosing has a plurality of apertures arranged in two columns for receiving the two support legs, wherein placement of the first support leg into an aperture in one column and the second support leg into an aperture in the other column adjusts a spatial relationship between the mattress and the air outlet.

4. The apparatus as recited in claim 1 further comprising a user, operable controller for activating the fan and the heater.

5. The apparatus as recited in claim 4 wherein the user operable controller enables the fan to be activated without activating the heater.

6. The apparatus as recited in claim 1 further comprising a timer for deactivating the heater after a defined period of time.

7. The apparatus as recited in claim 1 further comprising filter through which the flow of air passes.

8. The apparatus as recited in claim 1 further comprising a device which produces an audible signal indicating that the apparatus is operating.

9. An apparatus for warming a bed having a mattress over which a bed covering extends, said apparatus comprising:

a housing having a bottom wall with an air inlet and a side wall with at least one air outlet, a plurality of pairs of apertures in the side wall wherein the pairs of apertures are stacked vertically;

a heater within the housing;

a fan within the housing for producing a flow of air from the air inlet through the heater to the air outlet; and first and second support legs selectively received in one of the pairs of apertures to adjust and adapted to extend under the mattress to hold the housing along an edge of the mattress, wherein selection of the one pair of apertures in which the first and second support legs are received adjusts a spatial relationship of the housing to the mattress so that the flow of air from the air outlet is directed between the mattress and the bed covering.

10. The apparatus as recited in claim 9 further comprising a user operable controller for activating the fan and the heater.

11. The apparatus as recited in claim 10 wherein the user operable controller enables the fan to be activated without activating the heater.

12. The apparatus as recited in claim 9 further comprising a timer for deactivating the heater after a defined period of time.

* * * * *